US010541497B2

(12) United States Patent
Zhong et al.

(10) Patent No.: US 10,541,497 B2
(45) Date of Patent: Jan. 21, 2020

(54) ELECTRICAL CONNECTOR

(71) Applicant: FOXCONN INTERCONNECT TECHNOLOGY LIMITED, Grand Cayman (KY)

(72) Inventors: Wei Zhong, Kunshan (CN); Jian-Kuang Zhu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/015,147

(22) Filed: Jun. 21, 2018

(65) Prior Publication Data

US 2018/0375263 A1 Dec. 27, 2018

(30) Foreign Application Priority Data

Jun. 21, 2017 (CN) ..... 2017 1 0474662

(51) Int. Cl.

| | |
|---|---|
| ***H01R 9/03*** | (2006.01) |
| ***H01R 13/6582*** | (2011.01) |
| ***H01R 12/71*** | (2011.01) |
| ***H01R 13/502*** | (2006.01) |
| ***H01R 13/627*** | (2006.01) |
| ***H01R 13/516*** | (2006.01) |

(Continued)

(52) U.S. Cl.

CPC ..... *H01R 13/6582* (2013.01); *H01R 12/716* (2013.01); *H01R 13/502* (2013.01); *H01R 13/516* (2013.01); *H01R 13/6275* (2013.01); *H01R 12/707* (2013.01); *H01R 24/60* (2013.01); *H01R 2107/00* (2013.01)

(58) Field of Classification Search

CPC ..... H01R 13/65802; H01R 23/6873; H01R 23/025; H01R 13/658; H01R 23/7073

USPC ..... 439/607.01, 607.32, 607.35, 607.38, 439/607.55, 660

See application file for complete search history.

(56) References Cited

U.S. PATENT DOCUMENTS 6,305,982 B1 * 10/2001 Wu ..... H01R 12/707 439/607.32

6,315,580 B1 * 11/2001 Hurtubise ..... H01H 73/08 361/627

(Continued)

FOREIGN PATENT DOCUMENTS

CN 206516785 U 11/2016

*Primary Examiner* — Thanh Tam T Le

(74) *Attorney, Agent, or Firm* — Wei Te Chung; Ming Chieh Chang

(57) ABSTRACT

An electrical connector includes an insulative housing, a number of mating contacts fixed in the insulative housing and a shell covering the insulative housing. The insulative housing includes a base portion and a mating portion extending from the base portion. The base portion includes a mounting surface perpendicular to the mating portion. The base portion defines a mounting slot recessed from the mounting surface. The base portion includes two rows of contact receiving slots located at two sides of the mounting slot. The contact receiving slot includes an inner surface and two opposite side surfaces. The mating contact is inserted into the contact receiving slot and interfered with the side surfaces. The electrical connector also includes a fixing member mounted into the mounting slot. The fixing member has a number of fixing projections to engage with two rows of contacts, respectively.

18 Claims, 8 Drawing Sheets

(51) Int. Cl.

| | |
|---|---|
| *H01R 24/60* | (2011.01) |
| *H01R 12/70* | (2011.01) |
| *H01R 107/00* | (2006.01) |

(56) References Cited

U.S. PATENT DOCUMENTS

| | | | | |
|---|---|---|---|---|
| 7,267,578 | B2 * | 9/2007 | Wu | H01R 13/508 439/607.58 |
| 7,988,462 | B2 * | 8/2011 | Mao | H01R 12/724 439/79 |
| 7,993,161 | B2 * | 8/2011 | Mao | H01R 12/7052 439/607.4 |
| 8,142,224 | B2 * | 3/2012 | Wu | H01R 13/648 439/353 |
| 8,591,259 | B2 * | 11/2013 | Wu | H01R 13/6581 439/607.27 |
| 8,974,126 | B2 * | 3/2015 | Sloey | G02B 6/3817 385/93 |
| 9,429,360 | B2 * | 8/2016 | Hsiao | F26B 3/28 |
| 9,673,556 | B2 * | 6/2017 | Kao | H01R 13/502 |
| 9,742,123 | B2 * | 8/2017 | Yokoyama | H01R 13/648 |
| 9,755,370 | B2 * | 9/2017 | Little | H01R 13/6581 |
| 9,780,468 | B2 * | 10/2017 | Yokoyama | H01R 12/7047 |
| 9,853,393 | B2 * | 12/2017 | Guo | H01R 13/405 |
| 9,871,317 | B2 * | 1/2018 | Zhang | H01R 13/5216 |
| 9,935,398 | B2 * | 4/2018 | Yokoyama | H01R 13/05 |
| 9,979,102 | B2 * | 5/2018 | Zhao | H01R 9/032 |
| 10,096,949 | B2 * | 10/2018 | Zhang | H01R 12/707 |

* cited by examiner

ELECTRICAL CONNECTOR

1. FIELD OF THE DISCLOSURE

The invention is related to an electrical connector, and particularly to a waterproof structure of the electrical connector.

2. DESCRIPTION OF RELATED ARTS

U.S. Patent Publication No. 20180151986 discloses a USB type C connector including an insulative housing, a plurality of contacts received in the insulative housing, a metal latch and a shell surrounding around the insulative housing. The insulative housing includes a mounting surface, a capsular mating portion and a plurality of contact slots extending through the mounting surface to the capsular mating portion. The capsular mating portion defines a mating cavity. The contacts are inserted in the corresponding contacts slots from the mounting surface. The contact includes an elastic mating portion extending into the mating cavity, a fixing portion fixed in the contact slot and a soldering foot extending beyond the mounting surface. The metal latch includes a pair of locking heads extending to the mating cavity. The USB type C connector has a poor waterproof effect.

Therefore, it is desired to provide a new electrical connector.

SUMMARY OF THE DISCLOSURE

To achieve the above desire, an electrical connector includes an insulative housing, a plurality of mating contacts fixed in the insulative housing and a shell covering the insulative housing. The insulative housing includes a base portion and a mating portion extending from the base portion. The base portion includes a mounting surface perpendicular to the mating portion. The base portion includes a mounting slot recessed from the mounting surface. The base portion includes two rows of contact receiving slots at two sides of the mounting slot. The contact receiving slot includes an inner surface and two opposite side surfaces. The mating contact is inserted into the contact receiving slot and interfered with the side surfaces. The electrical connector also includes a fixing member mounted into the mounting slot. The fixing member is located between two rows of contacts. The fixing member has a plurality of fixing projections to engage with two rows of contacts, respectively.

DETAILED DESCRIPTION OF THE PREFERRED EMBODIMENT

Figure 1:
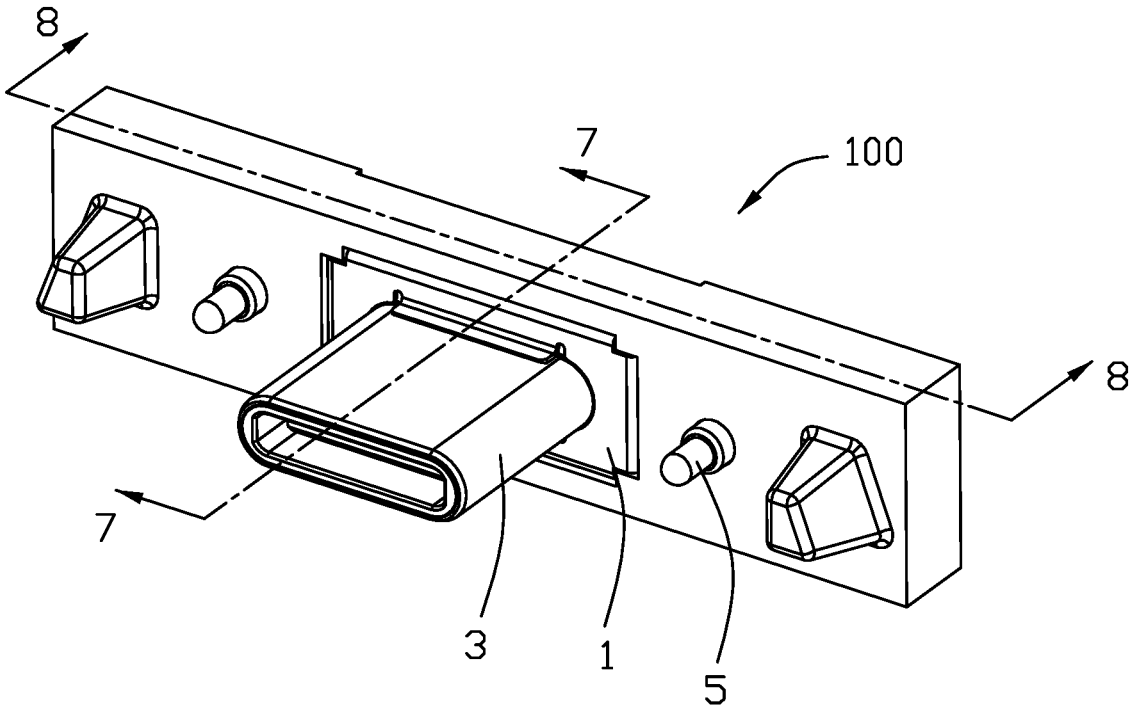
FIG. 1 is a perspective view of an electrical connector according to the invention.
Figure 2:
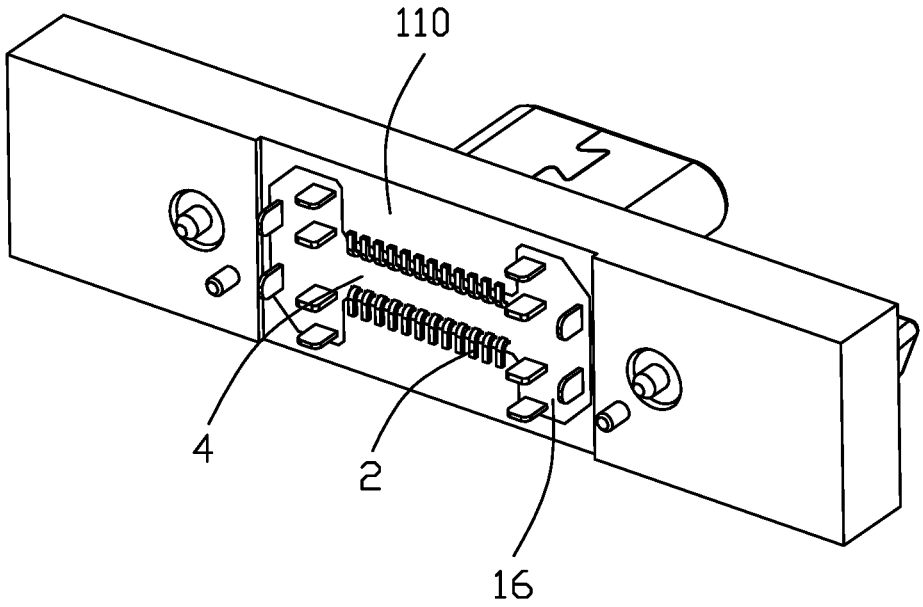
FIG. 2 is another perspective view of the electrical connector of FIG. 1.

Reference will now be made in detail to the embodiments of the present disclosure. Referring to FIGS. 1-2, an electrical connector 100 includes an insulative housing 1, a plurality of mating contacts 2 and a pair of auxiliary contacts 5 received in the insulative housing 1, a fixing member 4 mounted to the insulative housing 1, a waterproof member 6 located behind the fixing member 4 and a shell 3 surrounding around the insulative housing. The electrical connector 100 can transfer large electric current.

Referring to FIGS. 3-6, the insulative housing 1 includes a base portion 11 and a mating portion 12 extending from the base portion 11. The base portion 11 includes a central portion and a pair of side portions 13 extending from the central portion. The base portion 11 includes a mounting surface 110. The base portion 11 includes a plurality of mounting slots 111 recessed from the mounting surface 110. The mating portion 12 is perpendicular to the mounting surface 110 and defines a mating cavity 10. The base portion 11 defines two rows of contact receiving slots 112 located at two sides of the mounting slot 111. The contact receiving slots 112 communicates to the mating portion 12. Each of the contact receiving slots 112 includes an inner surface 1121 and two opposite side surfaces 1122. The base portion 11 includes a plurality of dividing walls 114 each located between two adjacent contact receiving slots 112. The insulative housing 1 includes a plurality of interferential walls 115 each extending from the dividing wall 114 to the mounting slot 111. The width of the interferential wall 115 is larger than the width of the dividing wall 114. The insulative housing 1 includes a dispensing slot 116 recessed from the mounting surface 110 and communicated to the mounting slot 111.

Figure 4:
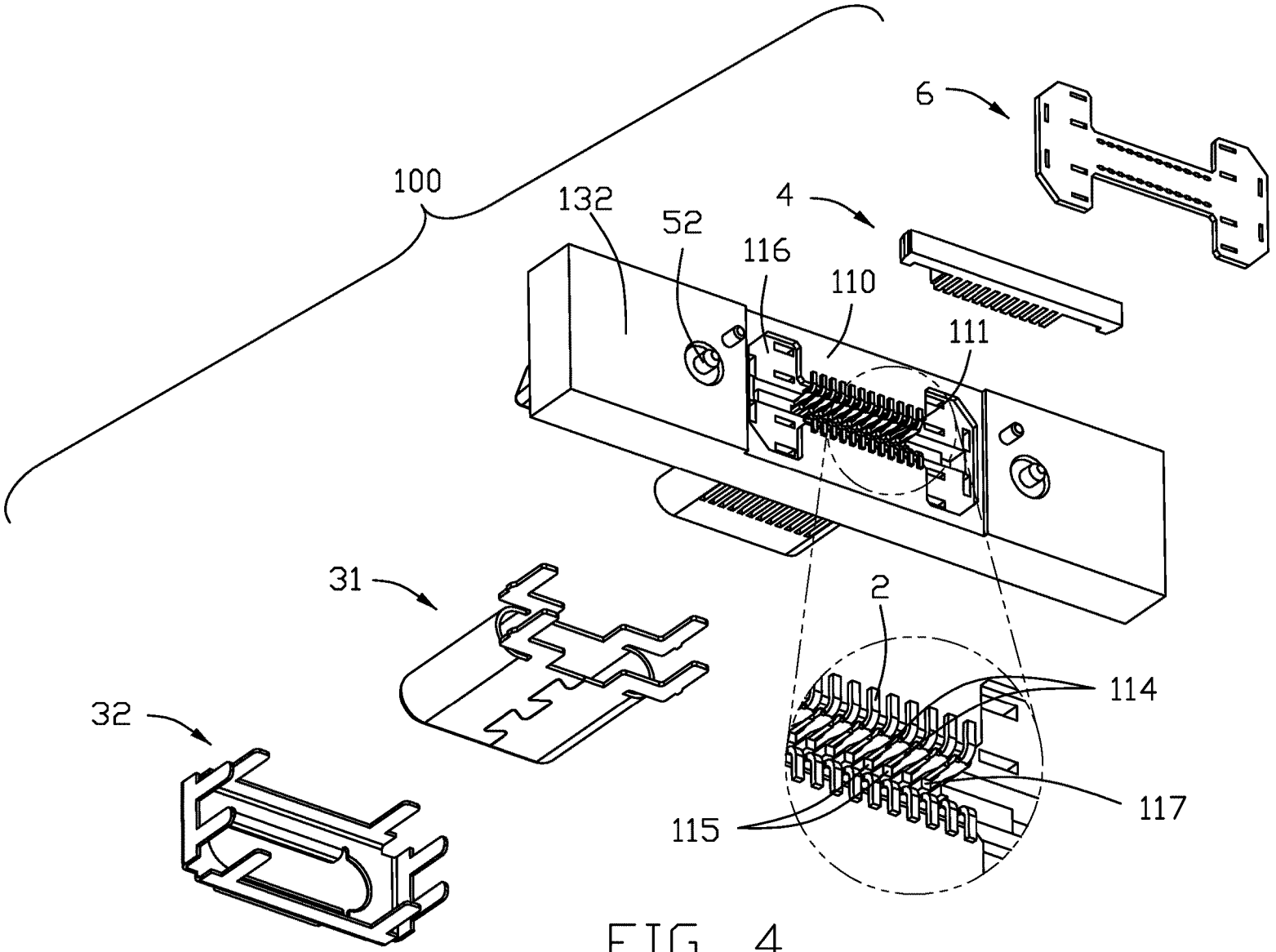
FIG. 4 is another perspective view of the electrical connector of FIG. 3.
Figure 5:
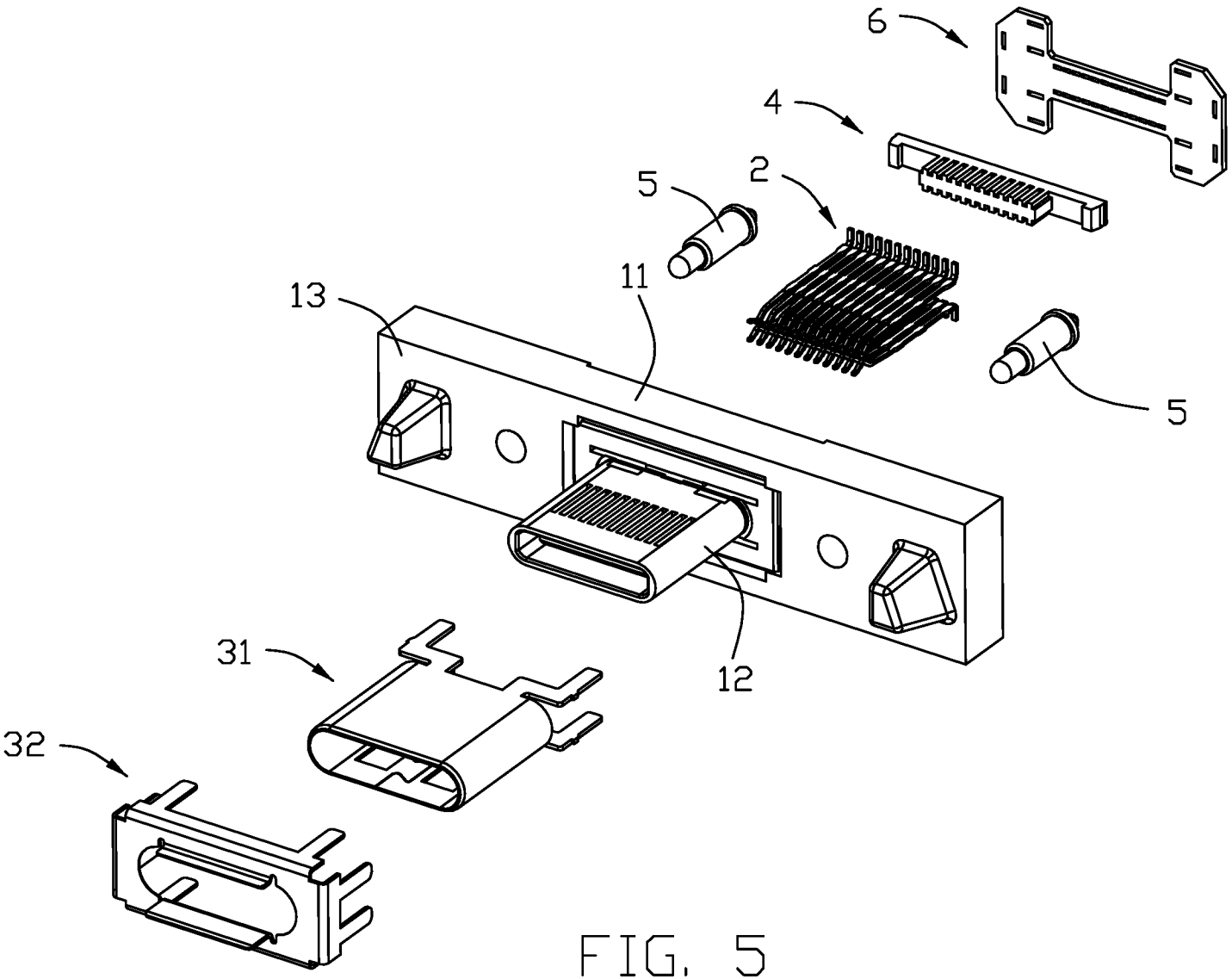
FIG. 5 is a further exploded perspective view of the electrical connector of FIG. 3.
Figure 6:
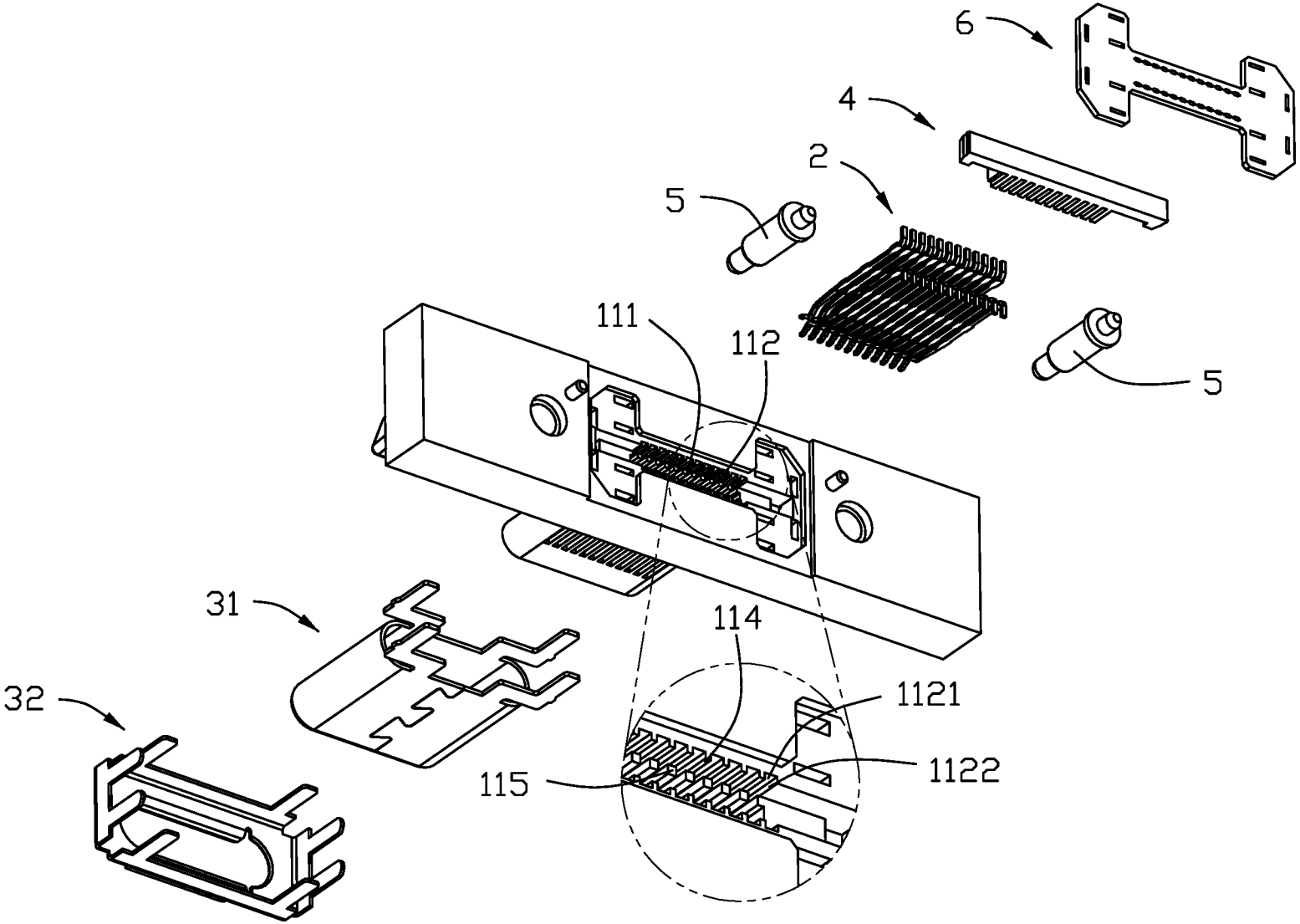
FIG. 6 is another perspective view of the electrical connector of FIG. 5.
Figure 7:
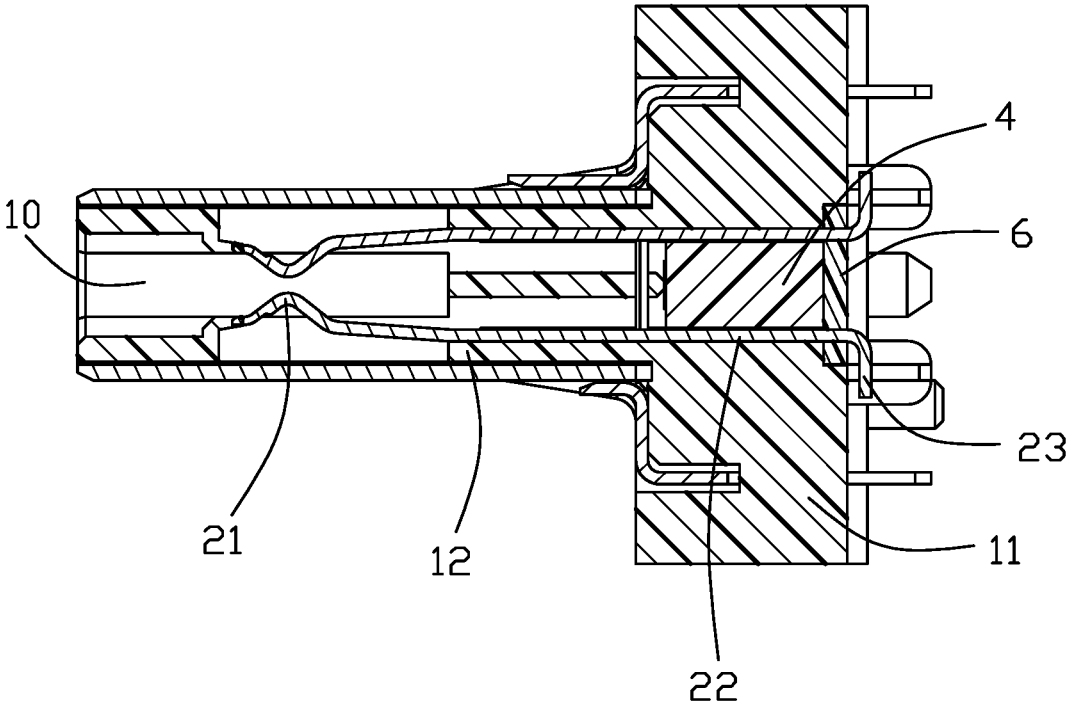
FIG. 7 is a sectional view of the electrical connector of FIG. 1 taken along line 7-7 thereof.
Figure 8:
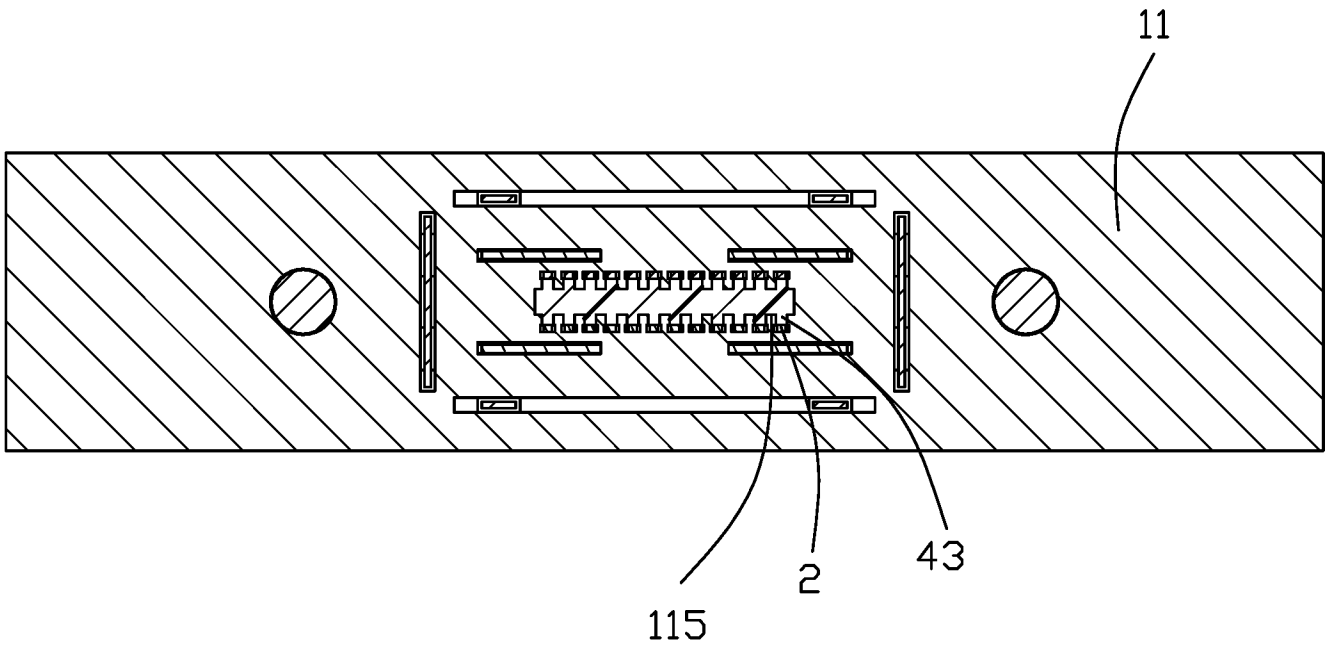
FIG. 8 is a sectional view of the electrical connector of FIG. 1 taken along line 8-8 thereof.

Referring to FIG. 4 and FIG. 7, each of the mating contacts 2 is inserted into the contact receiving slot 112 and interfered with two side surfaces 1122 of the contact receiving slot 112. The mating contact 2 is interfered with the inner surface 1121 at one side and another opposite side exposed to the mounting slot 111. The mating contact 2 includes an elastic contacting portion 21 extending into the mating cavity 10, a retention portion 22 fixed in a fixing slot and a soldering portion 23 extending beyond the mounting surface 110.

Referring to FIGS. 2-4 and FIGS. 7-8, the fixing member 4 includes a body portion 41 and an interferential potion 42 extending from the body portion 41. The interferential portion 42 includes a plurality of fixing projections 43. The fixing member 4 is mounted into the mounting slot 111 and located between two rows of the contacts 2. The interferential portion 42 is sandwiched between two rows of interferential walls 115. The fixing projection 43 is mounted between two adjacent interferential walls 115. In a horizontal direction, the mating contact 2 is interfered with two side surfaces 1122 of the contact receiving slot 112. In a vertical direction, the mating contact 2 is interfered with the fixing projection 43 of the fixing member 4 and the inner surface 1121 of the contact receiving slot 112. This can avoid liquid material flowing into an electrical equipment for a good waterproof effect.

Referring to FIGS. 2-4 and FIG. 7, the dividing wall 114 extends beyond the interferential wall 115, the base portion 11 includes a step face 117 formed between the dividing wall 114 and the interferential wall 115, the interferential portion 42 includes a relying face 44 between two adjacent fixing projection 43, the relying face 44 relies on the step face 117.

The fixing member includes a rear end exposed to the dispensing slot 116, the waterproof member 6 is formed in the dispensing slot 116.

Referring to FIGS. 1-4, the auxiliary contacts 5 are disposed at the side portions 13. The side portion 13 includes an auxiliary mating face 131 and an auxiliary mounting face 132. The auxiliary mounting face 132 extends beyond the mounting face 110. The auxiliary contact 5 includes a contacting portion 51 extending beyond the auxiliary mating face 131 and a soldering foot 52 extending beyond the auxiliary mounting face 132. In this embodiment, the contact 2 is USB type C plug contact, the auxiliary contact 5 is pogo pin contact.

Figure 3:
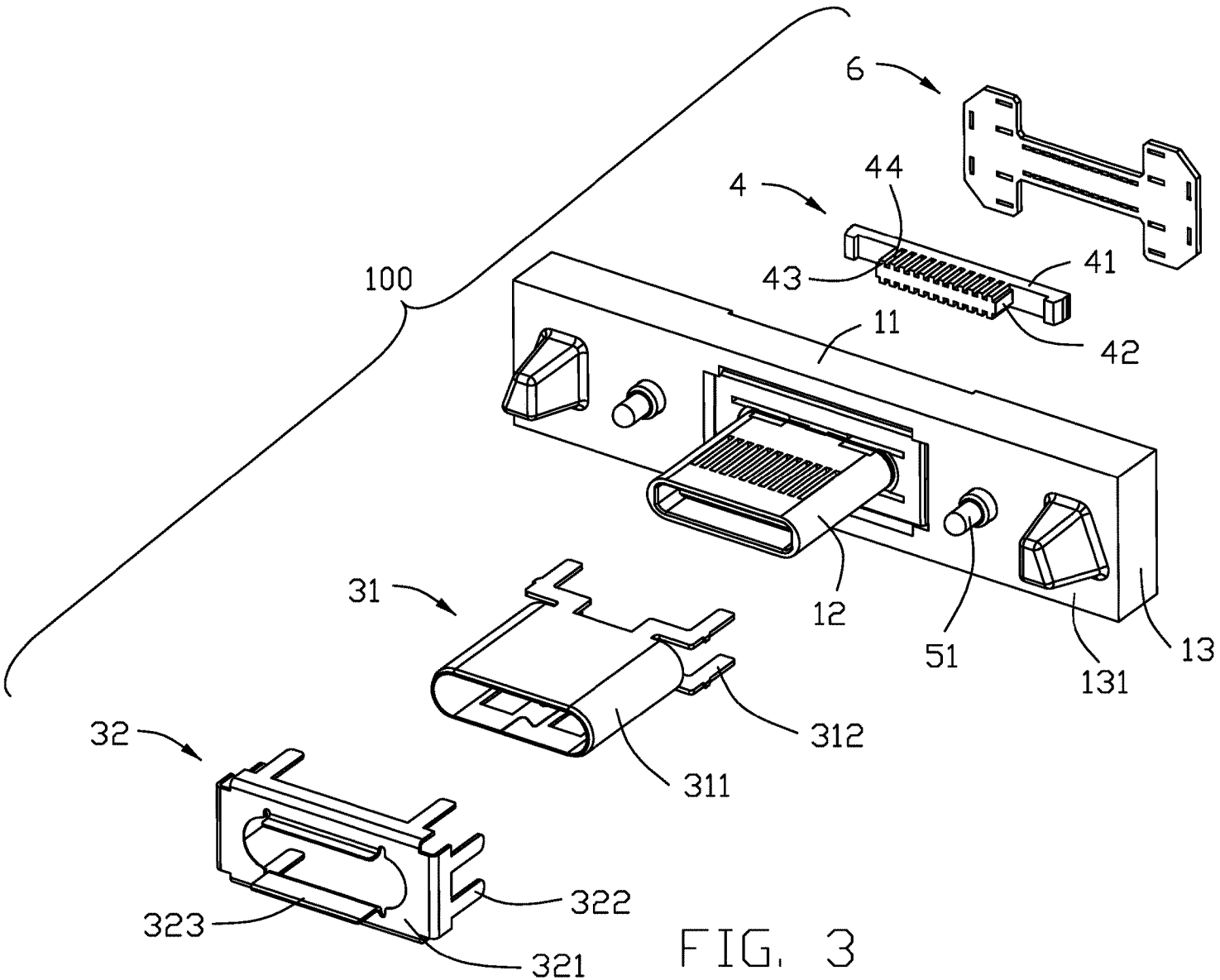
FIG. 3 is a partially exploded perspective view of the electrical connector of FIG. 2.

Referring to FIG. 1 and FIG. 3, the shell 3 includes an inner shell 31 and an outer shell 32. The inner shell 31 includes a tube portion 311 covering the mating portion 12 and a plurality of first mounting feet 312 extending through the base portion 11. The outer shell 32 includes a base plate 321 attached the base portion 11, a supporting portion 323 extending from the base plate 321 to two sides of the tube portion 311 and a plurality of second mounting feet 322 extending from the base plate 321. The first mounting feet 312 and the second mounting feet 322 are mounted to a printed circuit board.

While a preferred embodiment according to the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing having a base portion and a mating portion extending from the base portion, the base portion having a mounting surface perpendicular to the mating portion, the base portion defining a mounting slot recessed from the mounting surface, the base portion having two rows of contact receiving slots located at two sides of the mounting slot, the contact receiving slot having an inner surface and two opposite side surfaces;

a plurality of mating contacts fixed in the insulative housing, the mating contact inserted into the contact receiving slot and interfered with the side surfaces;

a shell covering the insulative housing; and a fixing member mounted into the mounting slot, the fixing member located between two rows of mating contacts has a plurality of fixing projections to engage with two rows of mating contacts, respectively;

wherein the fixing member completely occupies the mounting slot for sealing the corresponding contact receiving slots, and a waterproof member intimately located behind the fixing member and disposed in a dispensing slot formed in a mounting surface of the housing.

2. The electrical connector as claimed in claim 1, wherein the base portion includes two rows of dividing walls separating the corresponding contact receiving slots, two rows of interferential walls extending respectively from the corresponding dividing walls into the mounting slot, a width of each interferential wall being larger than a width of each dividing wall.

3. The electrical connector as claimed in claim 2, wherein the fixing projection is received within a cavity formed between two adjacent interferential wall.

4. The electrical connector as claimed in claim 2, wherein the dividing wall extends beyond the corresponding interferential wall, and the base portion has step faces each formed between the corresponding dividing wall and the corresponding interferential wall, and the fixing member has a body portion and an interferential portion extending from the body portion, and the interferential portion is located between the two rows of interferential walls, and the interferential portion includes said plurality of fixing projections, and the body portion has a plurality of relying faces each located between two adjacent fixing projections and resting on the corresponding step face.

5. The electrical connector as claimed in claim 1, wherein the dispensing slot communicates with the mounting slot, and the fixing member has a rear end exposed to the dispensing slot.

6. The electrical connector as claimed in claim 1, wherein the electrical connector is a USB type C plug connector.

7. An electrical connector comprising:

an insulative housing including a base portion extending in a horizontal plane and a mating portion extending upwardly from the base portion in a vertical direction, the base portion forming a mounting surface on a bottom end and a mounting slot recessed upwardly from the mounting surface, the housing having two rows of contact receiving slots located by two sides of the mounting slot in a transverse direction perpendicular to said vertical direction;

two rows of curved deflectable contacts upwardly inserted into and retained in the corresponding contact receiving slots, respectively;

a fixing member mounted into the mounting slot and including an interferential portion pressing the contacts located by two sides so as to have both said two rows of contacts tightly sandwiched between the fixing member and the housing in the transverse direction; and a waterproof member intimately attached under the fixing member and the mounting surface in the vertical direction; wherein each of the contacts extends through said fixing member for mounting to a printed circuit board under the housing; wherein the fixing member fully occupies the mounting slot for sealing the corresponding contact receiving slots.

8. The electrical connector as claimed in claim 7, wherein said body portion includes a plurality of fixing projections respectively pressing the corresponding contacts in the transverse direction.

9. The electrical connector as claimed in claim 8, wherein said base portion includes a plurality of interferential walls each of which is located between the two adjacent corresponding fixing projections in a longitudinal direction perpendicular to both said vertical direction and the transverse direction.

10. The electrical connector as claimed in claim 7, further including a metallic shell covering the housing, wherein said metallic shell includes mounting legs extending through said waterproof member in the vertical direction.

11. The electrical connector as claimed in claim 10, wherein said metallic shell includes an inner shell and an outer shell, respectively, and mounting legs of both said inner shell and said outer shell extend through the waterproof member.

12. The electrical connector as claimed in claim 7, wherein said fixing member further includes a body portion located below the interferential portion and larger than the interferential portion in a longitudinal direction perpendicular to both said vertical direction and said transverse direction.

13. The electrical connector as claimed in claim 12, wherein said waterproof member fully covers said fixing member.

14. The electrical connector as claimed in claim 12, wherein a dimension of said body portion of the fixing member along the longitudinal direction is similar to that of the metallic shell.

15. The electrical connector as claimed in claim 7, wherein said waterproof member is of a H-shape.

16. The electrical connector as claimed in claim 15, wherein all said contacts form horizontal type contact tails for mounting.

17. The electrical connector as claimed in claim 7, wherein the base portion includes a plurality of interferential walls respectively extending from the corresponding dividing walls into the mounting slot, each of the interferential wall being larger than that of the corresponding dividing wall, a step formed between each dividing wall and the corresponding interferential wall.

18. The electrical connector as claimed in claim 17, wherein the fixing member includes a plurality of relying faces each located between the corresponding adjacent two fixing projections and resting upon the corresponding step.

* * * * *